US005666925A

United States Patent [19]

Denz et al.

[11] Patent Number: 5,666,925

[45] Date of Patent: Sep. 16, 1997

[54] METHOD AND ARRANGEMENT FOR DIAGNOSING A TANK-VENTING SYSTEM

[75] Inventors: Helmut Denz, Stuttgart; Ernst Wild, Oberriexingen; Andreas Blumenstock, Ludwigsburg; Georg Mallebrein, Singen, all of Germany

[73] Assignee: Robert Bosch GmbH, Stuttgart, Germany

[21] Appl. No.: 647,757

[22] Filed: May 15, 1996

[30] Foreign Application Priority Data

May 18, 1995 [DE] Germany ..... 195 18 292.8

[51] Int. Cl.[6] ..... F02M 37/04

[52] U.S. Cl. ..... 123/520; 123/198 D

[58] Field of Search ..... 123/198 D, 520, 123/521, 519, 516, 518

[56] References Cited

U.S. PATENT DOCUMENTS

| | | | |
|---|---|---|---|
| 5,398,661 | 3/1995 | Denz et al. . | |
| 5,426,971 | 6/1995 | Glidewell | 123/516 |
| 5,445,133 | 8/1995 | Nemoto | 123/520 |
| 5,460,141 | 10/1995 | Denz | 123/198 D |
| 5,463,998 | 11/1995 | Denz | 123/198 D |
| 5,542,397 | 8/1996 | Takahata | 123/520 |

*Primary Examiner*—Carl S. Miller
*Attorney, Agent, or Firm*—Walter Ottesen

[57] ABSTRACT

The invention is directed to a method for checking the tightness of a tank-venting system used with an internal combustion engine having an intake pipe. The tank-venting system includes a fuel tank wherein fuel vapor forms, a storage device connected to the fuel tank, the storage device having a vent opening and a device for closing the vent opening, and a tank-venting valve interconnecting the intake pipe and the storage device whereby the fuel vapor is conducted from the tank to the intake pipe via the storage device and the tank-venting valve. The method includes the steps of: (a) during operation of the engine and while the venting opening is closed, carrying out one of the following: (a1) opening the tank-venting valve and drawing a predetermined quantity of gaseous substance through the tank-venting valve, or (a2) opening the tank-venting valve and drawing a gaseous substance through the tank-venting valve so long until a predetermined underpressure is reached in the tank-venting system, so that a pressure fluctuation is produced in the tank-venting system with the pressure fluctuation being characterized by a plurality of characteristic variables; (b) evaluating at least one of the characteristic variables to judge the tightness of the tank-venting system.

7 Claims, 4 Drawing Sheets

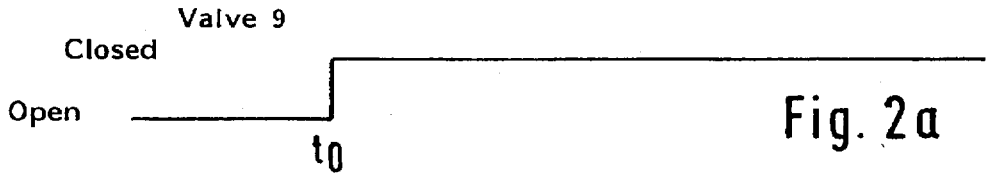
Fig. 2a
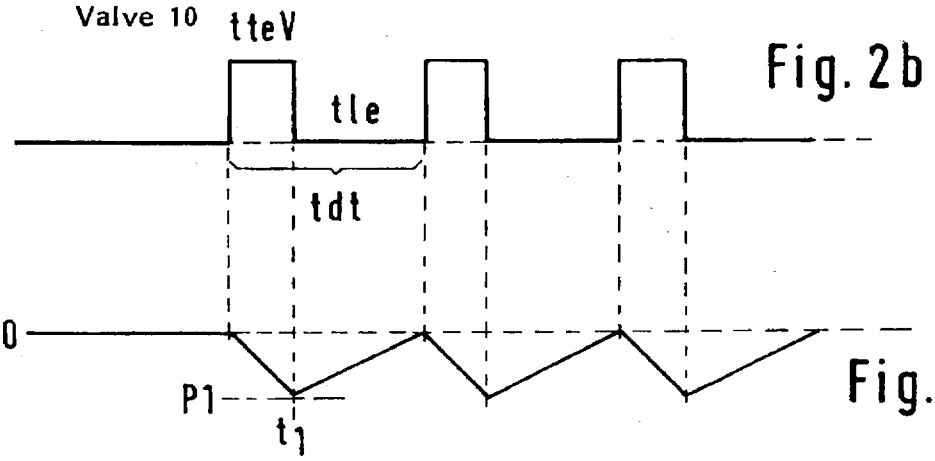
Fig. 2b
Fig. 2c
Fig. 4a
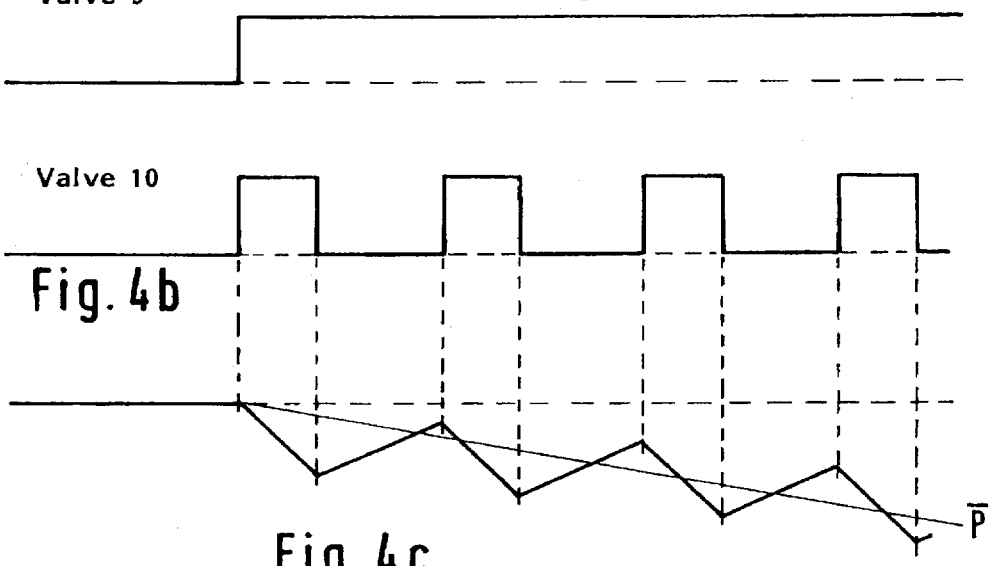
Fig. 4b
Fig. 4c

METHOD AND ARRANGEMENT FOR DIAGNOSING A TANK-VENTING SYSTEM

FIELD OF THE INVENTION

The invention relates to the diagnosis of systems which are used to vent fuel tanks in motor vehicles. The invention also relates to an arrangement for carrying out the method.

BACKGROUND OF THE INVENTION

In known systems, vaporized fuel in the tank is stored in an active-charcoal filter which is connected via a closable tank-venting valve to the intake pipe of the internal combustion engine. When the tank-venting valve is open, air is drawn in by suction via a connection of the active-charcoal filter to the ambient air. This drawn-in air entrains the intermediately stored fuel and is conducted to the combustion. The vapor quantity drawn by suction is so controlled via the tank-venting valve that, on the one hand, the charcoal filter is adequately scavenged with air and, on the other hand, no intolerably large disturbances of the fuel/air ratio of the mixture supplied to the engine occur.

In this way, emissions of fuel vapor are intended to be avoided for reasons of environmental protection.

This task however is only satisfied by tank-venting systems which have no leaks. Statutory requirements with respect to diagnosis exist according to which even very small leaks (<1 mm) can be detected during operation of the motor vehicle utilizing on-board means.

U.S. Pat. No. 5,398,661 discloses a method and an arrangement for checking the operability of a tank-venting system wherein a shutoff valve is mounted in the connection of the active-charcoal filter to the ambient. The diagnosis uses the underpressure in the intake pipe. For diagnosis, the tank-venting valve is first opened while the shutoff valve is closed and a check is made as to whether a pregiven minimum underpressure builds up within a predetermined time span. Thereafter, the tank-venting valve is again closed. The gradient of the pressure decay, which occurs in the interior of the tank-venting system, and of the subsequent pressure buildup is used to evaluate the tightness of the system. A rapid decay of the previously generated underpressure indicates that leakage is present. This underpressure method is preferably carried out during idle of the engine with the motor vehicle at standstill to obtain reliable diagnostic data. U.S. Pat. No. 5,383,437 discloses a further diagnostic method. This method operates with an additional overpressure pump which draws in a defined ambient air volume and compresses the same and conducts the same into the tank. The time in which the resulting pressure increase decays within the tank is used as a criterion for the tightness of the system.

SUMMARY OF THE INVENTION

It is an object of the invention to provide a diagnostic method which supplies reliable diagnostic data utilizing minimum system equipment. The diagnostic method of the invention operates without an additional expensive overpressure pump. It is also an object of the invention to provide an arrangement for carrying out the diagnostic method of the invention.

The method of the invention is for checking the tightness of a tank-venting system used with an internal combustion engine having an intake pipe. The tank-venting system includes a fuel tank wherein fuel vapor forms, a storage device connected to the fuel tank, the storage device having a vent opening and a device for closing the vent opening, and a tank-venting valve interconnecting the intake pipe and the storage device whereby the fuel vapor is conducted from the tank to the intake pipe via the storage device and the tank-venting valve. The method includes the steps of:

(a) during operation of the engine and while the venting opening is closed, carrying out one of the following:

(a1) opening the tank-venting valve and drawing a predetermined quantity of gaseous substance through the tank-venting valve, or (a2) opening the tank-venting valve and drawing a gaseous substance through the tank-venting valve so long until a predetermined underpressure is reached in the tank-venting system, so that a pressure fluctuation is produced in the tank-venting system with the pressure fluctuation being characterized by a plurality of characteristic variables;

(b) evaluating at least one of the characteristic variables to judge the tightness of the tank-venting system.

Experiments have shown that the method of the invention, compared to known methods operating with underpressure, exhibits an increased measuring sensitivity. For this reason, the reliability of diagnostic data is increased with the aid of the method of the invention.

According to an embodiment of the invention, a reliability of the diagnostic method is achieved virtually independently of the tank fill level by a variable fashioning of the vapor quantity drawn off by suction via the tank-venting valve.

BRIEF DESCRIPTION OF THE DRAWINGS

The invention will now be described with reference to the drawings wherein:

FIG. 2*a* is a waveform showing the state (open or closed) of the cutoff valve as a function of time;

FIG. 2*b* shows the state (open or closed) of the tank-venting valve as a function of time;

FIG. 2*c* shows the resulting pressure fluctuation detected by a pressure sensor as a consequence of the states of the cutoff and tank-venting valves;

FIG. 4*a* shows a waveform representing the state (open or closed) of the cutoff valve for another embodiment of the method of the invention;

FIG. 4*b* is a waveform showing the state (open or closed) of the tank-venting valve corresponding to the embodiment of FIG. 4*a;*

FIG. 4*c* shows the waveform of the pressure in the tank corresponding to the states of the valves shown in FIGS. 4*a* 4*b;* and, FIG. 5 is a schematic of an embodiment of an arrangement according to the invention for carrying out the diagnostic method of the invention.

DESCRIPTION OF THE PREFERRED EMBODIMENTS OF THE INVENTION

Figure 1:
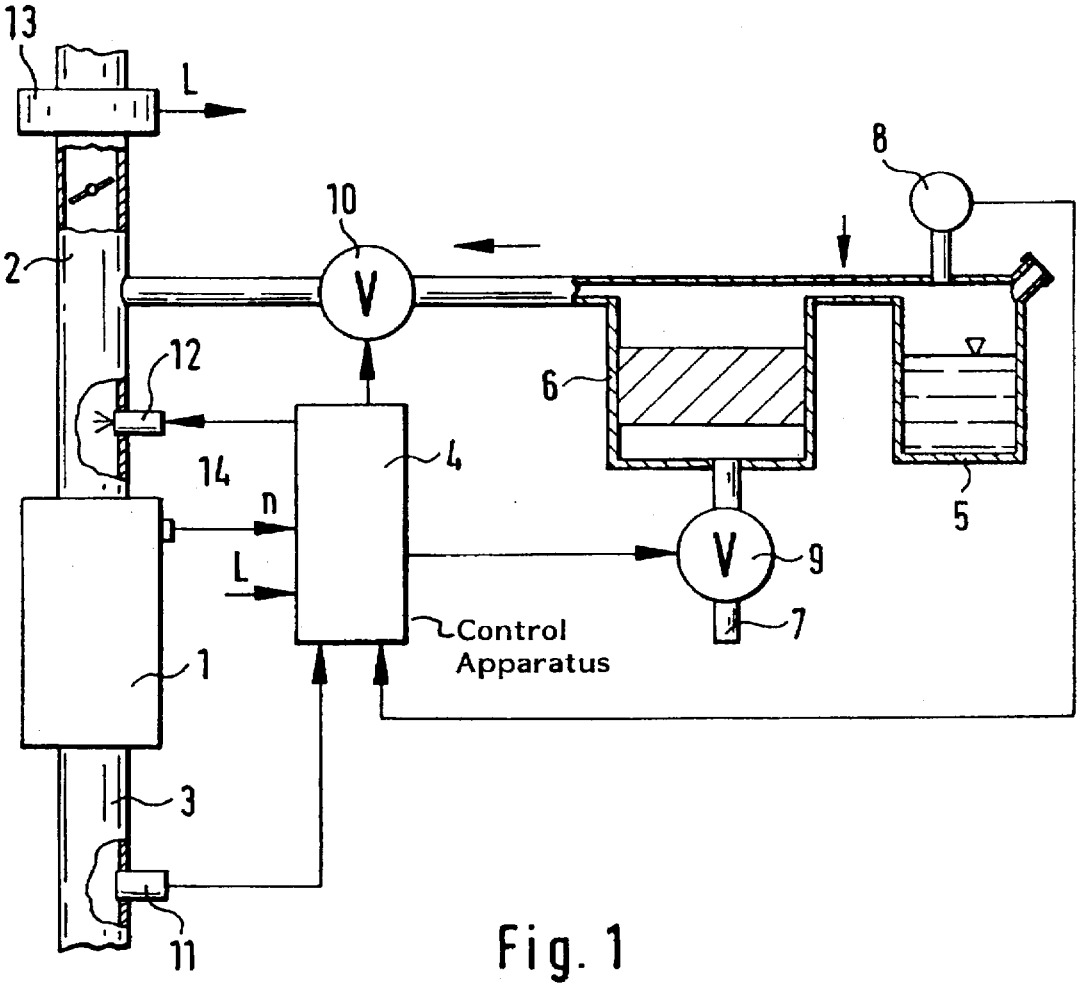
FIG. 1 is a schematic of a known system which is suitable for carrying out an embodiment of the method of the invention.

FIG. 1 shows an internal combustion engine 1 having an intake pipe 2, an exhaust-gas pipe 3, a tank-venting system, a control loop for adjusting the composition of the fuel/air mixture combusted in the engine as well as several actuating devices required for this purpose and sensors. A control apparatus 4 controls the interaction of these components.

The tank-venting system includes a fuel tank 5, a storage device 6, a pressure sensor 8 as well as a cutoff valve 9 and a tank-venting valve 10 through which fuel in a vaporous state is drawn into the intake pipe 2. The storage device 6 is connected via pipes or hose connections to the fuel tank and the intake pipe 2. The storage device 6 can be vented via a venting opening 7.

The mixture control loop includes an exhaust-gas probe 11 and a fuel metering device 12 to which fuel in a liquid state is supplied from tank 5 via a fuel line and a fuel pump (both not shown). Additional sensors include a detecting device 13 for detecting the air quantity inducted by the engine and an rpm sensor 14 to detect engine speed.

FIG. 2*a* shows a time-dependent curve of the closure state of the cutoff valve 9 for an embodiment of the invention. FIG. 2*b* shows the variation of the state (open or closed) of the tank-venting valve 10 and FIG. 2*c* shows the resulting pressure fluctuations as detected by the pressure sensor 8.

Figure 3:
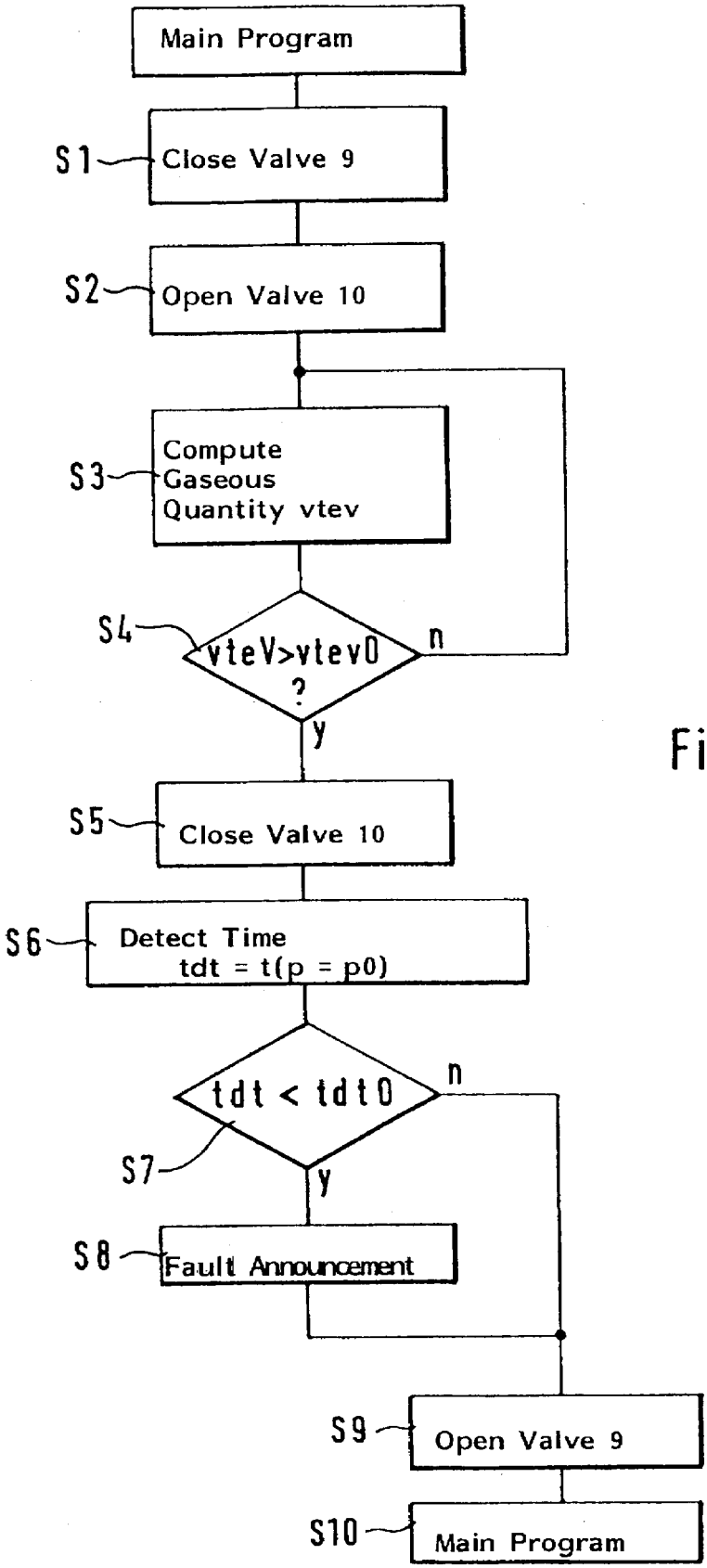
FIG. 3 shows an embodiment of the method of the invention in the context of a flowchart.

These signal curves are provided as a consequence of the method steps shown in FIG. 3. These method steps are triggered by the control apparatus 4.

Step S1 continues from a higher-ranking main program and closes the cutoff valve 9 at time point $t_0$. At the same time or thereafter, the tank-venting valve 10 is opened in step S2 and, in step S3, the quantity of the inducted vapor vtev is detected. This quantity can be detected as the product of the opening time ttev of the tank-venting valve and the volume flow $\dot{v}$tev. This volume flow $\dot{v}$tev flows via the tank-venting valve per unit of time during this open state and at the pressure conditions present. The pressure conditions at the tank-venting valve are determined by the intake pipe pressure and therefore by the operating state of the engine since the pressure fluctuations at the tank end are limited for reasons of safety. The fluctuation range of the pressure at the tank end then lies lower by approximately one order of magnitude than the fluctuation range of the pressure occurring at the intake-pipe end.

The volume flow $\dot{v}$tev can therefore be determined directly from the intake pipe pressure or, alternatively, for example, from a characteristic field of input variables (load, rpm) which simulate the course of the pressure in the intake pipe.

The predetermined vapor quantity vtev drawn off by suction can be determined in step S4 by a comparison of vtev to a threshold value vtev0. As soon as the predetermined vapor quantity vtev is drawn off by suction, the tank-venting valve is closed in step S5. A drop of pressure in the tank from a start value P0 to the value P1 is related to the withdrawal of the vapor quantity by suction as shown in FIG. 2*c*.

The tank pressure again increases after closure of the tank-venting valve. The speed of increase increases with the size of the leakage. The time tdt which passes until the tank pressure reaches a pregiven value such as the start pressure P0 is therefore a criterion for the magnitude of the leak. If this time tdt, which is detected in step S6, is, in step S7, less than a threshold value tdt0, then the system is deemed to be leaking which leads to an output and/or storage of a fault announcement in step S8. The method then continues with steps S9 and S10 (which are reached directly from step S7 when the system is intact) to open the cutoff valve 9 and return to the higher-ranking main program.

The time tlc=tdt−ttev can be compared to a corresponding modified threshold value as an alternative to the comparison of the time tdt to a threshold value.

As a further alternative, the leakage air quantity flowing through the leak can be computed from the volume ($\dot{v}$tev=vtev*ttev), which had been previously drawn off by suction and which has again flowed in, and the measured time tlc.

$$\dot{v}lc = vtev/tlc$$

The system is in order when the leakage flow $\dot{v}$lc is less than a permissible desired value.

When the influence of the vaporization of the fuel on the course of the pressure is known or can be estimated, then this influence can also be considered. This influence can, for example, be estimated from the performance of the lambda controller during the measurement. The vaporizing fuel alters the fuel/air mixture by enriching the latter and so causes a lambda shift which is corrected via the lambda control. The gasoline vapor flow caused by vaporization of the fuel can be computed from the control actuating variable (that is, the fuel flowing via the injection valves) and the air flow L to the engine measured by an air mass sensor. The measurement can either be disregarded or corrected. The check can be suppressed when the tank-venting valve is operated in the operating ranges wherein the computed throughflow through the valve has associated therewith large uncertainties. An increase of the precision is provided when the removal of liquid fuel from the tank by the fuel pump is considered. The closing of the tank-venting valve can also be triggered by reaching a predetermined underpressure P1 as an alternative to drawing off a specific vapor quantity by suction.

The various alternatives of this embodiment have in common that a single fluctuation can be evaluated to judge tightness. This fluctuation comprises the pressure drop caused by drawing off the predetermined vapor quantity by suction and the increase which follows.

The drawing off by suction is periodically repeated in the context of a further embodiment.

This can take place in that a drawing off by suction can be repeated after each elapse of a predetermined time span and that the averaged characteristic variables determined over several repetitions can be evaluated to judge the tightness of the tank-venting system.

As an alternative to the foregoing, the repetition can be triggered when a predetermined pressure, such as the start pressure P0, is again reached. A mean value is formed from the time tdt which repeats periodically and this mean value is compared to a pregiven threshold value. The periodic repetition and averaging enhances the reliability of the diagnosis. FIGS. 2*a* to 2*c* show the corresponding signal traces for this embodiment.

A predetermined volume can also be drawn off by suction at fixed time intervals as an alternative to repeating the step of drawing off by suction when a pressure threshold is again reached. The frequency of repetition and the volume per suction operation are so configured that the mean drawn-off volume flow corresponds to the leakage current which the government authority will just permit. The system is adequately tight when the pressure $\overline{P}$ lies below a threshold $\overline{P0}$ after a specific time. This embodiment is shown in FIGS. 4*a* to 4*c*.

A further embodiment of the invention is provided when, at the start of the method, the tank-venting valve is opened while the cutoff valve is closed so long until a specific first underpressure value P01 is reached. After this initialization, the method embodiments already described can be carried out.

The time duration in which the first underpressure value is reached is dependent upon the fill level of the fuel tank. The lower the fill level, the higher is the volume of vapor above the liquid fuel and the greater is the time which is required to reach the first underpressure value. In a like manner, the step of drawing off a specific quantity of vapor or opening the tank-venting valve for a specific time duration causes smaller pressure changes the lower the fill level is. In this way, the reliability of the diagnostic data can be affected by the empty tank.

To remedy this situation, in a further embodiment of the invention, the quantity of vapor drawn off by suction (that is, the time duration for which the tank-venting valve is open) is increased with decreasing fill level.

This can take place by extending the time duration in which the tank-venting valve is driven by the open signal. For venting valves which are clock driven, the pulse-duty factor of the open signal (that is, the ratio of the closed phases to open phases) can be changed in favor of the open phase. Both possibilities can also be combined with each other. As a measure for the fill level, each fill level signal present in the motor vehicle can be used. This includes the known float-lever transducer coupled to a potentiometer as well as methods wherein a conclusion can be drawn as to the fill level from pressure changes which occur, for example, as a consequence of driving the tank-venting valve and/or the cutoff valve.

In one method, and at the start of the diagnosis, the tank-venting valve is held open while the cutoff valve is closed until a predetermined underpressure results as start value for the pressure fluctuation which then adjusts. In this method, the value of the volumes (which are periodically drawn off by suction to adjust the pressure fluctuations) can be determined in dependence upon the speed with which the predetermined underpressure is reached as start value.

The dependence is then to be so selected that the value of the volumes to be drawn off by suction is selected to be that much greater the lower the speed is with which the start value is reached.

A change of the value of the volumes drawn off by suction can be realized by a variation of the pulse-duty factor driving the tank-venting valve and/or by a variation of the time duration during which the tank-venting valve is driven at a specific pulse-duty factor.

Figure 5:
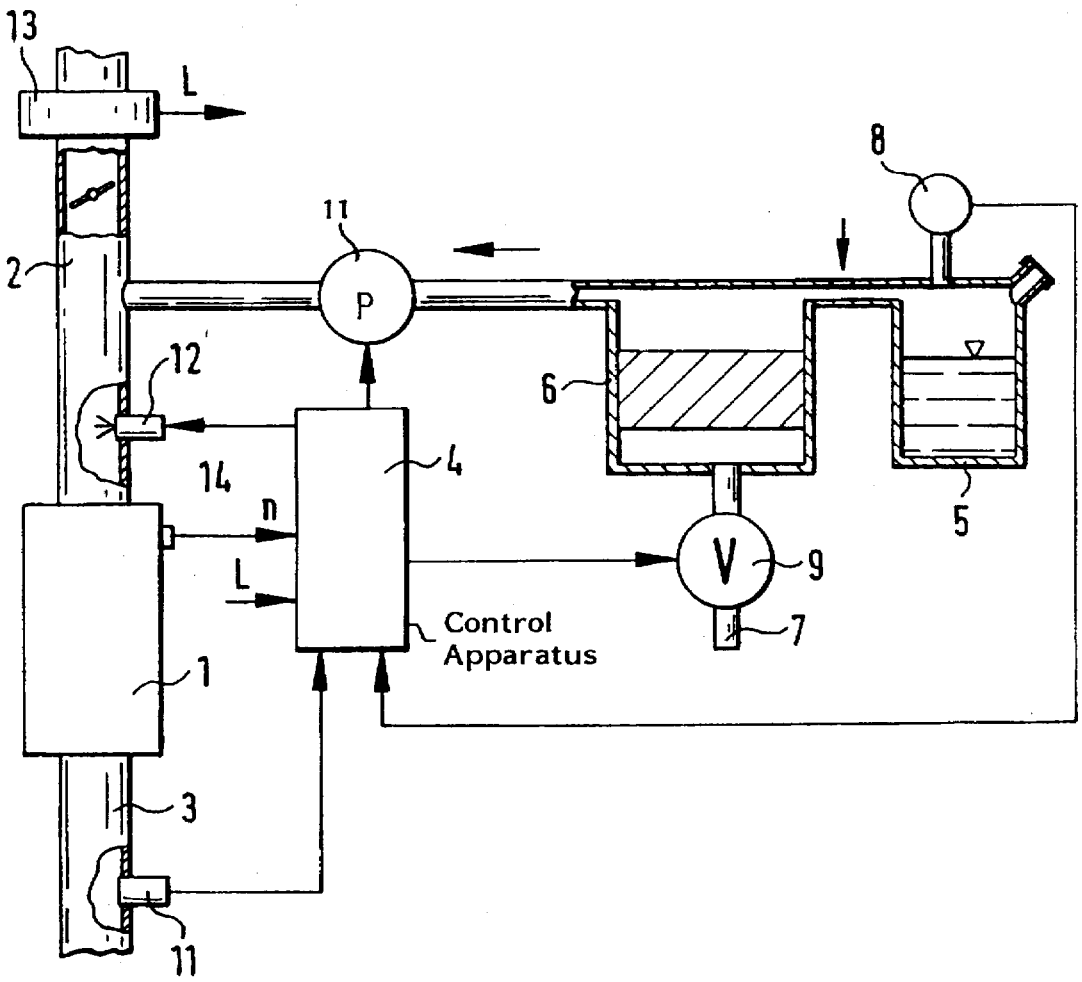

In lieu of the tank-venting valve, a regeneration-control device can be used as shown in FIG. 5 which includes at least an underpressure pump 11 mounted in the line connecting the intake pipe 2 to the storage device 6. The underpressure pump 11 is controlled by the control apparatus 4. Thus, for example, for charged engines, it can be necessary to install such a pump in order to carry out the method of the invention notwithstanding the comparatively high intake pipe pressure.

It is understood that the foregoing description is that of the preferred embodiments of the invention and that various changes and modifications may be made thereto without departing from the spirit and scope of the invention as defined in the appended claims.

What is claimed is:

1. A method for checking the tightness of a tank-venting system used with an internal combustion engine having an intake pipe, the tank-venting system including a fuel tank wherein fuel vapor forms, a storage device connected to the fuel tank, the storage device having a vent opening and a device for closing the vent opening, and a tank-venting valve interconnecting the intake pipe and said storage device whereby said fuel vapor is conducted from said tank to said intake pipe via said storage device and said tank-venting valve, the method comprising the steps of:

(a) during operation of the engine and while said venting opening is closed, carrying out one of the following:

(a1) opening said tank-venting valve and drawing a predetermined quantity of gaseous substance through said tank-venting valve, or (a2) opening said tank-venting valve and drawing a gaseous substance through said tank-venting valve so long until a predetermined underpressure is reached in said tank-venting system, so that a pressure fluctuation is produced in said tank-venting system with said pressure fluctuation being characterized by a plurality of characteristic variables;

(b) evaluating at least one of said characteristic variables to judge the tightness of said tank-venting system;

closing said tank-venting valve after carrying out each set of said steps (a) and (b) until the pressure reduction caused by said opening thereof is again compensated;

determining the mean closure time of said tank-venting valve over several periods of pressure compensation;

forming a criterion for the tightness of said tank-venting system from said mean closure time as a characteristic variable of said pressure fluctuation;

repeating said steps (a) and (b) after each elapse of a predetermined time span thereby averaging said characteristic variable; and, evaluating said characteristic variable to judge the tightness of said tank-venting system.

2. The method of claim 1, further comprising the step of determining said tank-venting system to leak when said mean closure time is less than a predetermined value.

3. A method for checking the tightness of a tank-venting system used with an internal combustion engine having an intake pipe, the tank-venting system including a fuel tank wherein fuel vapor forms, a storage device connected to the fuel tank, the storage device having a vent opening and a device for closing the vent opening, and a tank-venting valve interconnecting the intake pipe and said storage device whereby said fuel vapor is conducted from said tank to said intake pipe via said storage device and said tank-venting valve, the method comprising the steps of:

(a) during operation of the engine and while said venting opening is closed, carrying out one of the following:

(a1) opening said tank-venting valve and drawing a predetermined quantity of gaseous substance through said tank-venting valve, or (a2) opening said tank-venting valve and drawing a gaseous substance through said tank-venting valve so long until a predetermined underpressure is reached in said tank-venting system, so that a pressure fluctuation is produced in said tank-venting system with said pressure fluctuation being characterized by a plurality of characteristic variables;

(b) evaluating at least one of said characteristic variables to judge the tightness of said tank-venting system;

closing said tank-venting valve after carrying out said steps (a) and (b) and then again opening said tank-venting valve after a predetermined time has elapsed;

predetermining the frequency of the repetition of said steps (a) and (b) and the volume of said gaseous substance drawn off each time so that the average volume flow drawn off by suction corresponds to a leakage flow which is just permissible;

judging said tank-venting system as not being tight when the mean value of said pressure fluctuation determined over several periods does not drop by a predetermined minimum value; and, generating a periodic pressure fluctuation by directly repeating said method periodically.

4. A method for checking the tightness of a tank-venting system used with an internal combustion engine having an intake pipe, the tank-venting system including a fuel tank wherein fuel vapor forms, a storage device connected to the fuel tank, the storage device having a vent opening and a cutoff valve for closing the vent opening, and a tank-venting valve interconnecting the intake pipe and said storage device whereby said fuel vapor is conducted from said tank to said intake pipe via said storage device and said tank-venting valve, the method comprising the steps of:

(a) with said cutoff valve closed, opening said tank-venting valve so long until a predetermined underpressure is provided as a start value for the subsequent pressure fluctuation;

(b) during operation of the engine and while said venting opening is closed, carrying out one of the following:

(b1) opening said tank-venting valve and drawing a predetermined quantity of gaseous substance through said tank-venting valve, or (b2) opening said tank-venting valve and drawing a gaseous substance through said tank-venting valve so long until a predetermined underpressure is reached in said tank-venting system, so that a pressure fluctuation is produced in said tank-venting system with said pressure fluctuation being characterized by a plurality of characteristic variables; and, (c) evaluating at least one of said characteristic variables to judge the tightness of said tank-venting system.

5. A method for checking the tightness of a tank-venting system used with an internal combustion engine having an intake pipe, the tank-venting system including a fuel tank wherein fuel vapor forms, a storage device connected to the fuel tank, the storage device having a vent opening and a cutoff valve for closing the vent opening, and a tank-venting valve interconnecting the intake pipe and said storage device whereby said fuel vapor is conducted from said tank to said intake pipe via said storage device and said tank-venting valve, the method comprising the steps of:

(a) with said cutoff valve closed, opening said tank-venting valve so long until a predetermined underpressure is provided as a start value for the subsequent pressure fluctuation;

(b) during operation of the engine and while said venting opening is closed, carrying out one of the following:

(b1) opening said tank-venting valve and drawing a predetermined quantity of gaseous substance through said tank-venting valve, or (b2) opening said tank-venting valve and drawing a gaseous substance through said tank-venting valve so long until a predetermined underpressure is reached in said tank-venting system, so that a pressure fluctuation is produced in said tank-venting system with said pressure fluctuation being characterized by a plurality of characteristic variables;

(c) evaluating at least one of said characteristic variables to judge the tightness of said tank-venting system; and, (d) determining the value of the volumes of said gaseous substances, which are drawn off by suction to adjust the pressure fluctuations periodically, in dependence upon the speed with which the predetermined underpressure as said start value is reached.

6. The method of claim 5, further comprising the step of selecting said volumes to be greater the lower said speed is to be with which said start value is to be reached.

7. The method of claim 6, further comprising the steps of:

driving said tank-venting valve at a pulse-duty factor which can be varied and carrying out at least one of the following steps:

varying the value of said volumes by varying said pulse-duty factor; and, varying the time duration during which said tank-venting valve is driven with a specific value of said pulse-duty factor.

* * * * *

UNITED STATES PATENT AND TRADEMARK OFFICE

CERTIFICATE OF CORRECTION

PATENT NO. : 5,666,925

DATED : September 16, 1997

INVENTOR(S) : Helmut Denz, Ernst Wild, Andreas Blumenstock and Georg Mallebrein

It is certified that error appears in the above-indentified patent and that said Letters Patent is hereby corrected as shown below:

In column 4, line 3: delete "*tlc=vtev/tlc*" and substitute -- $\dot{v}lc$ = vtev / tlc -- therefor.

Signed and Sealed this

Twenty-first Day of July, 1998

Bruce Lehman

*Attest:*

BRUCE LEHMAN

*Attesting Officer*

*Commissioner of Patents and Trademarks*